US006656676B2

(12) United States Patent
Iwagaki et al.

(10) Patent No.: US 6,656,676 B2
(45) Date of Patent: Dec. 2, 2003

(54) SILVER HALIDE COLOR PHOTOGRAPHIC MATERIAL

(75) Inventors: Masaru Iwagaki, Hino (JP); Makoto Nomiya, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/222,627

(22) Filed: Aug. 16, 2002

(65) Prior Publication Data

US 2003/0165785 A1 Sep. 4, 2003

(30) Foreign Application Priority Data

Aug. 24, 2001 (JP) ..... 2001/254074

(51) Int. Cl.[7] ..... G03C 1/34
(52) U.S. Cl. ..... 430/614; 430/613

(58) Field of Search ..... 430/614, 613

(56) References Cited

U.S. PATENT DOCUMENTS 5,422,232 A * 6/1995 Asami et al. ..... 430/533
6,127,108 A * 10/2000 Kita et al. ..... 430/546

* cited by examiner

*Primary Examiner*—Hoa Van Le
(74) *Attorney, Agent, or Firm*—Muserlian, Lucas and Mercanti, LLP

(57) ABSTRACT

A silver halide color graphic material is disclosed, comprising a support having on one side thereof a red-sensitive layer unit, a green-sensitive layer unit, a blue-sensitive layer unit and a light-insensitive layer, wherein an oil-soluble organic basic compound exhibiting a pKa value of 5.5 to 8.5, and a cationic starch are used in combination.

10 Claims, No Drawings

SILVER HALIDE COLOR PHOTOGRAPHIC MATERIAL

FIELD OF THE INVENTION

The present invention relates to a silver halide color photographic light sensitive material, and in particular to a silver halide color photographic material, which is improved so that stable photographic performance can be achieved even under an environment containing a relatively high quantity of gases adversely affecting photographic materials.

BACKGROUND OF THE INVENTION

Silver halide color photographic materials (hereinafter, also denoted simply as photographic materials, after manufacture thereof are delivered not only in a light-shielding package but also in a package reducing influences of the external environment. Thus, to shield physical impact, temperature, humidity and harmful gases from the outside, photographic materials are loaded into a film cassette or cartridge, put into a resin vessel or packed with sheet material resistant to moisture or gas permeation. Further, in the case of a lens-fitted film package, a camera body is packaged with sheet material exhibiting low moisture or gas permeability.

However, after a user breaks the shield of a purchased photographic material and loads it into a camera, the user takes care for adverse physical impact, temperature and humidity by himself but cannot provide protection from harmful gases. In cases when silver halide color photographic material is stocked while loaded in a camera under an environment containing a relatively high quantity of a harmful gas over a long period of time, the harmful gas enters the camera through the opening, resulting in aging deterioration in speed or other photographic performance and making it difficult to achieve stable performance. Such changes occur markedly in exposed portions in contact with the harmful gas, depending on the enclosing state, rather than being uniformly occurring overall on the photographic material, and unnatural non-uniformity in image density is produced. It is difficult to deal with such problems by making corrections in printing, so that an improvement thereof is desired.

In years past, problems exist due to formaldehyde gas released from adhesives used in furniture and various techniques to solve such problems were disclosed and put into practice. For example, a technique for enhancing resistance to formalin gas was disclosed in JP-B No. 63-32378 and 1-32977 (hereinafter, the term, JP-B refers to Japanese Patent Publication), JP-A No. 58-10738, 61-272743, 62-54259, 63-214745, 1-237651 and 1-297642 (hereinafter, the term, JP-A refers to Japanese Patent Application Publication); JP-B No. 60-40016 disclosed a technique for enhancing formalin gas resistance by the use of a specific magenta coupler, thereby achieving markedly improved effects.

However, it was proved that recent changes of user's lifestyle have resulted in the presence of harmful gases other than the foregoing formaldehyde gas, leading to the likelihood of adversely affecting photographic performance of silver halide color photographic material.

For example, it was proved that running an oil fan heater in a well sealed room in the winter season resulted in the probability of deteriorating photographic performance of a silver halide color photographic material which was loaded in a camera placed therein. This was supposed to be due to the fact that enhanced combustion efficiency of the oil fan heater, compared to conventional oil stoves, resulted in increased release of nitrogen oxide, which was further increased by the well sealed homes. This has become obvious by popularization of oil fan heaters and change in home environments.

SUMMARY OF THE INVENTION

It is an object of the present invention to provide an improved silver halide color photographic material so that stable photographic performance can be achieved even under an environment containing a relatively high quantity of gases adversely affecting photographic materials.

It is another object of the invention to provide a silver halide color photographic material, photographic performance of which is little affected even when stocked in a room using an oil fan heater.

The above objects of the invention can be accomplished by the following constitution:

A silver halide color photographic material comprising a support having on one side thereof photographic component layers comprising a red-sensitive layer unit, a green- sensitive layer unit, a blue-sensitive layer unit and a light-insensitive layer, wherein at least one of the photographic component layers contains an oil-soluble organic basic compound exhibiting an acid dissociation constant (pKa) of 5.5 to 8.5, and at least one of the photographic component layers contains a cationic starch.

DETAILED DESCRIPTION OF THE INVENTION

In the invention, an oil-soluble organic basic compound exhibiting a pKa value of 5.5 to 8.5 is useful to achieve the objects of the invention. As is commonly known, the pKa value refers to a logarithmic acid dissociation constant (Ka), i.e., pKa=−logKa, which is also called an acid electrolytic dissociation exponent. The pKa value of the oil-soluble basic compound can be determined by the alkalimetry, in the following manner. Thus, 50 mg pf a compound sample is dissolved in 40 ml of ethanol and after adding 10 ml of distilled water thereto, 3 ml of a 0.5 mol/l hydrochloric solution and 12 ml of ethanol are further added. The thus prepared solution is subjected to an alkalimetry at a temperature of 25° C. using an alkaline solution (which is comprised of 2.0 g of sodium hydroxide, 200 ml of distilled water and 800 ml of ethanol) and an automatic titration apparatus (Auto Titrator AUT-301, available from TOA electronics, Ltd.).

The oil-soluble basic compound relating to the invention preferably exhibits a log P value of 6 to 14, and more preferably 8 to 14. The log P value, which is also denoted as logarithm of octanol-water partition coefficient, is a parameter concerning water-solubility. The log P value can generally be determined by the octanol-water extraction method.

The oil-soluble basic compound of the invention refers to a compound, which soluble in a high boiling solvent used in silver halide color photographic materials (e.g., dioctyl phthalate, di-I-decyl phthalate, tricresyl phosphate, trioctyl phosphate, 2,4-dinonylphenol, etc.) and is capable of forming a salt with a mineral acid, such as hydrochloric acid, sulfuric acid, or nitric acid. The oil-soluble basic compound preferably exhibits a solubility of at least 1 g in 100 ml of ethyl acetate at 40° C., and it is more preferable that 1 wt % of the oil-soluble basic compound in a ethanol/water solution (=8/2 by volume ratio) at 25° C. exhibits a pH higher by at least 0.1 than a pH of a ethanol/water solution (=8/2 by volume ratio) at 25° C., and at least 5 g of the basic compound is soluble in 100 ml ethyl acetate at 40° C. It is still more preferable that the foregoing oil pH variation is at least 2 and solubility in 100 ml ethyl acetate is at least 10 g.

The oil-soluble organic basic compounds used in the invention are preferably a compound represented by the following formula (V), as described in U.S. Pat. No. 6,127,108:

formula (V)

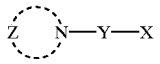

wherein X represents an electron-attractive group having a Hammett's substituent constant σp value of 0.25 or more; Y represents an alkylene group in which the carbon number of the main chain is 1 through 3; Z represents a non-metallic atom group necessary for forming a 5- to 7-membered non-aromatic heterocycle together with a nitrogen atom as shown in formula (V), and wherein when Z contains a second nitrogen atom and there is no nitrogen atom in Z more than two, the compound includes a substituent (—Y'—X') which is attached to the second nitrogen, in which X' is the same as defined in X and Y' is the same as defined in Y, X and X' or Y and Y' may be the same or different, provided that there is no basic amino group other than a basic skeleton of a non-aromatic heterocycle represented by

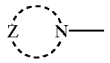

and the number of the carbon atoms in the molecule is 14 or more.

In the formula (V), the electron-attractive group represented by X is selected from the group consisting of a cyano group, carboxyl group, an acetyl group, a trifluoromethyl group, trichloromethyl group, a bezoyl group, an acetyloxy group, a methanesulfonyl group, a methanesufinyl group, benzenesulfonyl group, carbamoyl group, methoxycarbonyl group, an ethoxycarbonyl group, a phenylcarbonyl group, a methanesulfonyloxy group, a pyrazoyl group, a dimethoxyphosphoryl group,

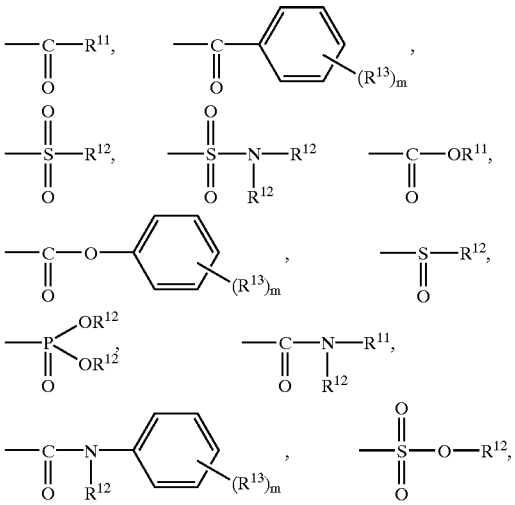

-continued

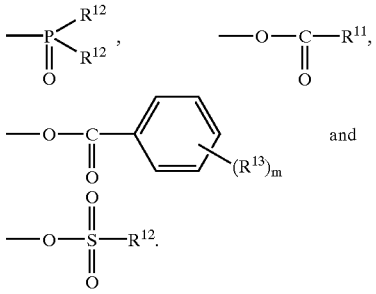

wherein $R^{11}$ represents a straight chain, branched or cyclic alkyl group; $R^{12}$ represents a hydrogen atom, an aryl group or $R^{11}$; m represents an integer of 0 through 5; $R^{13}$ represents a nitro group, a cyano group, a hydroxyl group, an alkoxy group, an aryloxy group, an acyl group, an acyloxy group, an acylamino group, a sulfonamide group, a carbamoyl group, a sulfamoyl group, a sulfonyl group, a sulfinyl group, an alkoxycarbonyl group, an aryloxycarbonyl group, a sulfonyloxy group, a halogen atom, an aryl group, an alkylthio group, an arylthio group, an alkenyl group or $R^{11}$; and the alkyl group represented by $R^{11}$ may be substituted by a substituent cited in $R^{13}$.

Of the compounds represented by the foregoing formula (V), preferred compounds are those of Nos. 92 through 147, described in U.S. Pat. No. 6,127,108, col. 18 to 23.

Specifically preferred examples of the oil-soluble basic compound are shown below.

OC-2

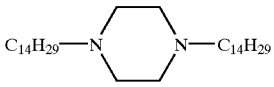

OC-3

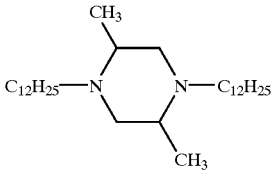

OC-4

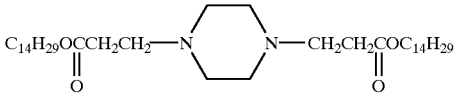

OC-5

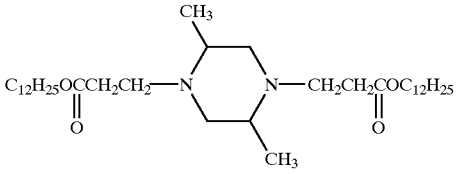

OC-6

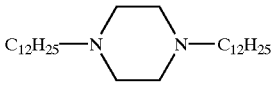

It is preferred that the oil-soluble organic basic compound used in the invention be basically dissolved in a high boiling solvent (also denoted as HBS), followed by being dispersed in a binder such as gelatin and incorporated in the form of an oil in water type dispersion. Alternatively, after dissolved in a low boiling solvent (also denoted as LBS), it may be directly incorporated. In case of the compound being solid, it may be incorporated in the form of a fine solid particle dispersion.

In the invention, the oil-soluble organic basic compound is contained in at least one of the component layers of a silver halide color photographic material according to the invention and is preferably contained in at least one light-sensitive layer of the photographic material. The oil-soluble organic basic compound may be contained in the light sensitive layer and a layer adjacent to the light-sensitive layer. In cases where the oil-soluble organic basic compound is contained in a light-sensitive layer containing light-sensitive silver halide, the content thereof is preferably 0.001 to 1 mol, and more preferably 0.002 to 0.5 mol per mol of silver halide. In cases where contained in a light-insensitive layer, the content thereof is preferably 0.01 to 0.5 parts, and more preferably 0.02 to 0.3 parts, based on a binder forming the layer.

In the invention, the foregoing oil-soluble organic basic compound is used in combination with a cationic starch, resulting in enhanced effects of the invention. The cationic starch refers to a starch having a positive charge as a whole when dispersed in water. The term, starch includes natural starches and modified derivatives thereof, such as dextrine-modified, hydrolyzed, alkylated, hydroxyalkylated, acetylated or fractionated starch. These starches are derived from corn starch, wheat starch, potato starch, tapioca starch, sago starch, rice starch, waxy corn starch or high-amylose corn starch. In general, the starch includes structurally two different polysaccharides, α-amylose and amylopectin. Both of them contain a α-D-glucopyranose unit. In α-amylose, for example, the -D-glucopyranose unit forms a 1,4-long-chained polymer and the repeating unit thereof can be represented by the following formula:

formula 1

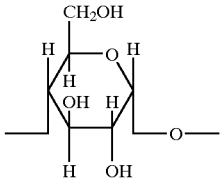

In amylopectin, in addition to the 1,4-bonding, a chain is evidently branched at the 6-position (e.g., at the site of the —$CH_2OH$ group in the above repeating unit) to form a polymer having a branched chain. Repeating units of starch and cellulose are diastereoisomers, which provide different formal dimensions to their molecules. An α-anomer, which exists in starch, represented by the foregoing formula 1, is a polymer capable of crystallizing and forming a hydrogen bond between repeating units of adjacent molecules to an extent (but is not the same extent as a β-anomer repeating unit of cellulose and cellulose derivatives). A polymer molecule formed of a β-anomer exhibits strong hydrogen bonding between adjacent molecules, resulting in crystallinity much higher than a solid mass formed of polymer molecules. Starch and its derivatives, which lack a substituent arrangement in favor for strong intermolecular bonding, as seen in the foregoing cellulose repeating unit, are much more easily dispersible in water.

Starch causes esterification or etherification usually at one or more free hydroxy sites, thereby allowing a cationic substituent group to be attached to the α-D-glucopyranose unit to form a cation. Typical reactive cation-providing reagents include a primary, secondary or tertiary amino group (which is subsequently capable of being protonated to form a cation under intended conditions), or quaternary ammonium, sulfonium or phosphonium group.

The cationic starch used in the invention has to be water-dispersible. Most starches can be dispersed in water by heating for a short time (e.g., 5 to 30 min.) at a temperature lower than boiling. High-shearing mixing promotes dispersion of the starch. The presence of a cationic substituent increases polarity of the starch molecule, making dispersion easier. Starch molecules are dispersed preferably at a colloid level and ideally at a molecular level to be dissolved.

Water-dispersible cationic starches falling with the scope intended in the invention are described in U.S. Pat. Nos. 2.989,520, 3,017,294, 3,051,700, 3,077,469, 4,060,683, 4,127,563, 4,613,407, 4,964,915, 5,227,481, and 5,349,089.

The cationic starch may be incorporated into any hydrophilic colloid layer (or photographic component layer) of the photographic material of the invention. Incorporation of the cationic starch into the hydrophilic colloid layer is preferably in an amount of 2 to 50% by weight, and more preferably 5 to 45% by weight, based on the whole binder of the hydrophilic colloid layer. When the cationic starch content is less than the above range, enhanced effects of the invention cannot be achieved, and the content exceeding the above range often results in reduced layer strength. As described above, the oil-soluble organic basic compound and the cationic starch, each may be contained in any component layer of the photographic material of the invention. It is preferred that the cationic starch be contained in a component layer farther from the support than a component layer containing the basic compound or be contained in the component layer containing the basic compound. It is more preferred that the cationic starch be contained in the component layer containing the basic compound.

In one preferred embodiment of the invention, the use of a compound represented by the following formula (1) in combination with the foregoing oil-soluble organic basic compound results further enhanced effects of the invention:

$$RaOCO(CH_2)_mCOORb \qquad \text{formula (1)}$$

wherein Ra and Rb are independently a straight chain or branched alkyl group having 4 to 10 carbon atoms; and m is an integer of 2 to 10. Examples of the alkyl group represented by Ra or Rb include butyl, iso-butyl, 2-ethylhexyl, tert-octyl, sec-octyl, nonyl, iso-nonyl, decyl and isodecyl; and m is an integer of 2 to 12, and preferably 4 to 10.

Exemplary examples of the compound of formula (1) are shown below:

HBS1; $C_4H_9OCO(CH_2)_4COOC_4H_9$

HBS2; $(CH_3)_2CHOCO(CH_2)_6COOCH(CH_3)_2$

HBS3; $C_4H_9OCO(CH_2)_8COOC_4H_9$

HBS4; $C_6H_{13}OCO(CH_2)_6COOC_6H_{13}$

HBS5; $C_4H_9(C_2H_5)CHCH_2OCO(CH_2)_4COOCH_2CH(C_2H_5)C_4H_9$

HBS6; $C_4H_9OCO(CH_2)_{10}COOC_4H_9$

HBS7; $C_4H_9OCO(CH_2)_{12}COOC_4H_9$

HBS8; $(CH_3)_2CHOCO(CH_2)_{12}COOCH(CH_3)_2$

HBS9; $(n)C_9H_{19}OCO(CH_2)_4COOC_9H_{19}(n)$

HBS10; $(t)C_5H_{11}OCO(CH_2)_6COOC_5H_{11}(t)$

The compound of formula (1) may be incorporated into any of hydrophilic colloid layers (or component layer) of the photographic material relating to the invention. When the compound of formula (1) is incorporated into the hydrophilic colloid layer, the compound is incorporated preferably in an amount of 2 to 50%, and more preferably 5 to 45% by weight, based on the total binder content of the hydrophilic layer. When the content of the compound of formula (1) is less than the above range, enhanced effects of the invention cannot be achieved, and the content exceeding the above range often results in reduced layer strength. The compound of formula (1) may be singly incorporated into the hydrophilic colloid layer and the compound is used preferably as a high boiling solvent to incorporate a dye forming coupler or other photographic useful compounds into the component layer. Alternatively, it is preferred to use the compound formula (1) as a high boiling solvent to incorporate the oil-soluble organic basic compound. In this regard, it is specifically preferred that the oil-soluble organic basic compound and a dye forming coupler form oil droplets together with the compound of formula (1).

In the invention, it is preferred to incorporate a compound capable of forming a bivalent cation upon auto-oxidation, into at least one of the component layers, thereby resulting in further enhanced effects of the invention.

Of the compounds capable of forming a bivalent cation through auto-oxidation is preferred a compound exhibiting a difference of enthalpy of formation between the bivalent cation formed through auto-oxidation and its neutral state ($\Delta\Delta H$) of more than 1700 kJ/mol and less than 2000 kJ/mol, and more preferably more than 1900 kJ/mol and less than 2000 kJ/mol. The difference $\Delta\Delta H$ is a value which is calculated in the semi-empirical molecular orbital theory using a AM1 Hamiltonian. The AM1 Hamiltonian is one of NDDO approximations used in the semi-empirical molecular orbital theory and an approximation, which has broadly been employed since presented by J. J. P Stewart in J. Am. Chem. Soc. 107, 3902 (1987). Representative software to calculate the $\Delta\Delta H$ include WinMOPAC ver. 2 (JCPE-P116, available from FUJITSU LTD).

Of the foregoing compounds capable of forming a bivalent cation upon auto-oxidation is preferred a compound represented by the following formula (4):

$$(E)_k\text{-}L_0\text{-}(Z_0)_1 \qquad \text{formula (4)}$$

wherein E represents an adsorption group onto silver halide, $L_0$ represents a bond or a linkage group, $Z_0$ represents a group capable of forming two-electron oxidant structure (i.e., bivalent cation structure) upon oxidation, k is 0 or an integer of 1 to 3 and 1 is 1 or 2.

The adsorption group onto silver halide refers to a group promoting adsorption onto the silver halide grain surface. Examples of the group represented by "E" include an atomic group forming styryl dyes, cyanine dyes or merocyanine dyes, an atomic group having a mercapto group (e.g., groups such as mercaptooxazole, mercaptotetrazole, mercaptotriazole, mercaptodiazole, mercaptothiazole, mercaptothiadiazole, mercaptooxazole, mercaptoimidazole, mercaptobenzothiazole, mercaptobenzoxazole, mercaptobenzimidazole, mercaptotetrazaindene, mercaptopyridyl, mercaptoquinolyl, 2-mercaptopyridyl, mercaptophenyl, and mercaptonaphthyl), an atomic group having a thione group (e.g., groups such as thiazoline-2-thione, oxazoline-2-thione, imidazoline-2-thione, benzothiazoline-2-thione, benzoimidazoline-2-thione, and thiazoline-2-thione), an atomic group forming an imino-silver (e.g., groups such as triazole, tetrazole, benzotriazole, hydroxyazaindene, benzimidazole, and indazole), an atomic group having an ethynyl group {e.g., groups such as 2-[N-(2-propinyl)amino]benzthiazole, N-(2-propinyl)carbazole}, and an atomic group containing a mesoionic compound, i.e., a compound group as defined in W. Baker & W. D. Ollis, Quart. Rev. 11, 15 (1957) and Advances in Heterocyclic Chemistry, vol. 19, 1 (1976), which is a 5- or 6-membered heterocyclic compound and cannot be satisfactorily represented by a single covalent bond structure formula or polar structure formula, and which is a compound having π-electrons relevant to all atoms constituting the ring having a partial positive charge and compensating for an equivalent negative charge on atoms or atomic group outside the ring. Examples of a mesoionic ring of the mesoionic compound include an imidazolium ring, pyrazolium ring, oxazolium ring, thiazolium ring, trazolium ring, tetrazolium ring, thiadiazolium ring, oxadiazolium ring, thiatriazolium ring, and oxatriazolium ring.

The linkage group represented by $L_0$, linking E and $Z_0$ include a substituted or unsubstituted alkylene group having 1 to 10 carbon atoms and a group derived from an aromatic hydrocarbon group or a heterocyclic group. The substituted or unsubstituted alkylene group having 1 to 10 carbon atoms may include a heteroatom or may form a ring.

The group represented by $Z_0$and capable of forming two-electron oxidant structure upon oxidation (or a two-electron oxidation product), preferably contains at least two atoms selected from sulfur, selenium and tellurium atoms and more preferably sulfur atom within the molecule.

Examples of the compound capable of forming a bivalent cation upon autooxidation are shown below but are not limited to these.

(T-1)

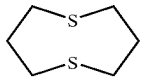

(T-2)

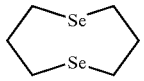

(T-3)

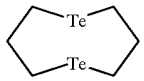

(T-4)

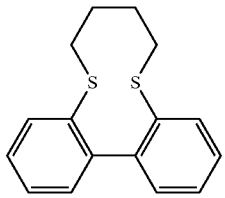

(T-5)

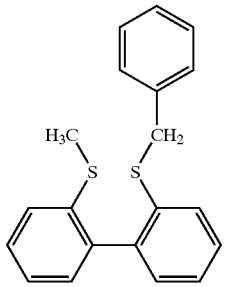

(T-6)

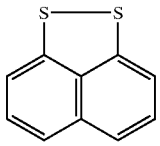

-continued (T-7)

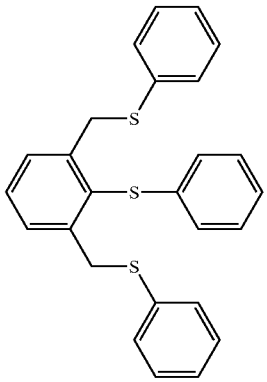

(T-8)

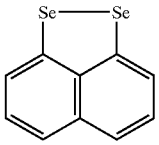

(T-9)

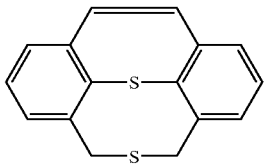

(T-10)

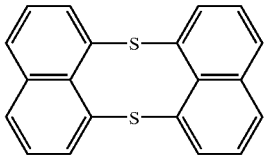

(T-11)

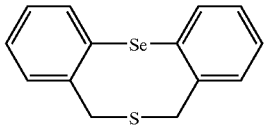

(T-12)

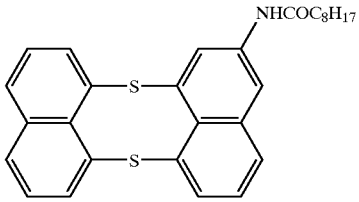

(T-13)

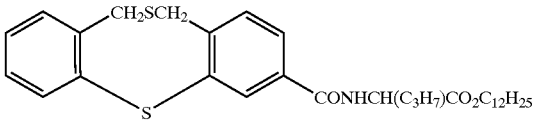

(T-14)

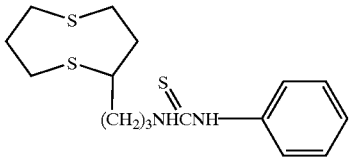

-continued (T-15)

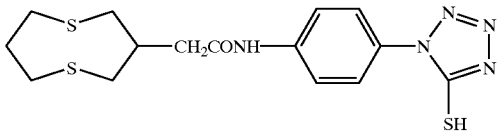

(T-16)

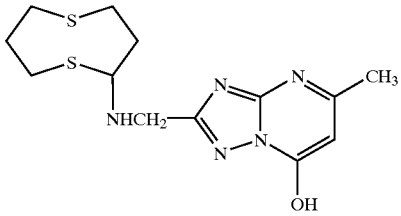

(T-17)

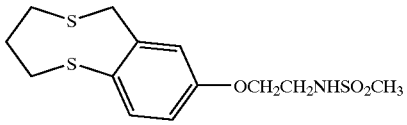

(T-18)

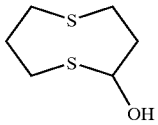

The compound capable of forming a bivalent cation upon autooxidation refers to a compound that forms, through oxidation, a bivalent cation as an oxidation product. Exemplified compound (T–1), for example, forms a bivalent cation according to the following reaction scheme:

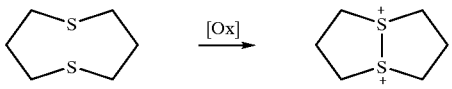

The compound capable of forming a bivalent cation upon autooxidation may be incorporated into any of the hydrophilic colloid layers and preferably into a layer containing light-sensitive silver halide. The compound capable of forming a bivalent cation upon autooxidation is incorporated preferably in an amount of $1.0\times10^{-6}$ to $1.0\times10^{-2}$, and more preferably $5.0\times10^{-6}$ to $1.0\times10^{-3}$ mol per mol of silver halide pf the light-sensitive layer. Even in cases where contained in the light-insensitive layer, making silver halide contained in a light-sensitive layer closest thereto a standard, the compound may be incorporated in the range as described above. The content of the compound forming a bivalent cation upon autooxidation being less than the foregoing contents cannot results in sufficient effects of the invention and the content exceeding the foregoing contents often cause fogging.

Incorporation of a radical scavenger in combination with the oil-soluble organic basic compound into at least one of the photographic component layer displays further enhanced effects of the invention. When an ethanol solution of 0.05 mmol/dm$^3$ of galvinoxyl and an ethanol solution of 0.05 mmol/dm$^3$ test compound are mixed by the stopper flow method at 25° C. and variation of absorbance at 430 nm with time is measure, the radical scavenger refers to a compound that cause galvinoxyl to be substantially discolored (i.e., decreases the absorbance at 430 nm). In the case of being undissolvable in the foregoing concentration, a concentration may be lowered to perform the measurement thereof. The discoloring rate constant of galvinoxyl, obtained in the manner described above is preferably not less than 0.01 $mmol^{-1}S^{-1}dm^3$ and more preferably not less than 0.1 $mmol^{-1}S^{-1}dm^3$. The method for determining a radical scavenging rate using galvinoxyl is described in Microchemical Journal 31, 18–21 (1985); the stopper flow method is referred, for example, to Bunko-Kenkyu vol. 19, No. 6, page 321 (1970). Radical scavenger compounds relating to the invention and the use thereof are also described in JP-A No. 8-76311. Preferred radical scavengers are compounds Nos. 2-1 through 2-10, 2-31 through 2-47 and 2-51 through 2-54 described in JP-A No. 2001-109093, col. [0070] through [0076].

Examples of useful radical scavengers in the invention are shown below but are not limited to these.

(2-1)

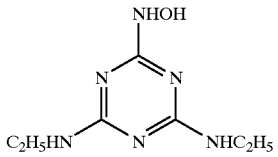

(2-2)

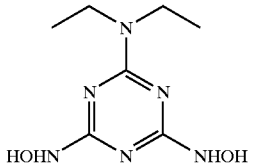

(2-3)

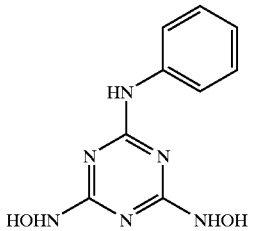

(2-4)

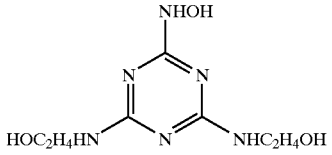

(2-5)

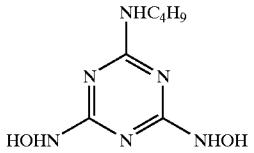

(2-6)

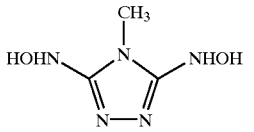

(2-7)

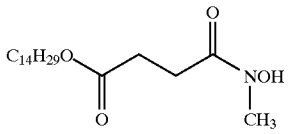

-continued (2-8)

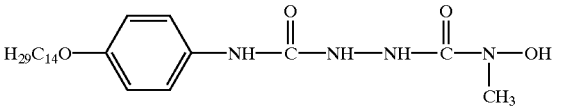

The radical scavenger is incorporated preferably in an amount of $1.0\times10^{-6}$ to $1.0\times10^{-2}$, and more preferably $5.0\times10^{-6}$ to $1.0\times10^{-3}$ mol per mol of silver halide pf the light-sensitive layer. Even in case of being contained in the light-insensitive layer, making silver halide contained in a light-sensitive layer closest thereto a standard, the radical scavenger may be incorporated in the range as described above. The content of the radical scavenger being less than the foregoing contents cannot results in sufficient effects of the invention and the content exceeding the foregoing contents often adversely affect gradation.

In one preferred embodiment of the invention, the surface of a light-insensitive layer farthest from the support among the component layers exhibits a layer surface pH of 5.6 to 6.2 and a film silver potential of the photographic material is 80 to 130 mV.

The layer surface pH refers to a pH on the surface of the outermost layer, which is provided on the silver halide emulsion layer side of the support of the photographic material and farthest from the support. In this case, the outermost layer is light-insensitive layer. The layer surface pH can be determined in the following manner. Thus, pure water is dropped onto the layer surface of a measurement sample in an amount of 20 $\mu$l (micro-liter) per $m^2$ using a micro syringe, a planar electrode is pressed thereon and after 30 sec., the ph is read. There can be used, for example, multiple electrode GST-S213F, available from TOA DENPA KOGYO Ltd as the planar electrode. The layer surface pH of the photographic material relating to the invention can be adjusted in accordance with commonly employed methods, for example, by adding an acid or alkali to a coating solution for the outermost layer. Such an acid or alkali may be mixed with the coating solution in advance or may be added to the coating solution immediately before coating to adjust the pH. There can be used, as a pH-adjusting agents for the coating solution, acids such as hydrochloric acid, sulfuric acid, formic acid, acetic acid, citric acid and boric acid, and alkali salts such as sodium hydroxide, potassium hydroxide, sodium carbonate, potassium carbonate, potassium citrate, lithium citrate, sodium acetate, potassium acetate and ammonia. In the invention, the layer surface pH is preferably 5.6 to 6.2, and more preferably 5.8 to 6.0. The layer surface pH exceeding 6.2 often deteriorated raw stock stability of the photographic material, causing fogging and the layer surface pH less than 6.2 often led to reduction in sensitivity or deterioration in physical property of the layer.

In the invention, the film silver potential refers to a silver potential of the whole layers coated of the light-sensitive layer side of the photographic material (i.e., the overall silver potential of the component layers provided on the light-sensitive layer side of the support. The film silver potential can be determined, for example, in the following manner. Thus, 500 $cm^2$ of the photographic material cut to strips and immersed in 100 ml of water in a dark room for 6 hrs., and measured using a silver ion electrode and a saturated silver-silver chloride electrode as a reference electrode. In case of light-insensitive layer(s) such as a backing layer being provided on the opposite side from the light-sensitive layer, such light-insensitive layer(s) are removed prior to the above measurement. In the invention, the layer silver potential is preferably 80 to 130 mV, more preferably 90 to 120 mV, and still more preferably 95 to 110 mV. The layer silver potential can be adjusted by adding an aqueous solution of a compound having function of adjusting the silver potential, such as $AgNO_3$, KBr, NaBr and KCl to coating solutions used to form the component layers to attain an intended layer silver potential. A coating solution to be added with an aqueous solution for adjusting the layer silver potential may be a coating solution to form a light-insensitive layer farthest from the support, adjacent layer thereto or other layer. In cases when added to the coating solution to form the adjacent layer or other layer, a silver potential of the surface layer can be adjusted through diffusion during coating or drying. Alternatively, an aqueous silver potential-adjusting solution may be added to coating solutions to form all of the layers of the light-sensitive layer side.

The silver halide color photographic material comprising, on one side of a support, photographic component layers comprising a red-sensitive layer unit, a green-sensitive layer unit, a blue-sensitive layer unit and a light-insensitive layer, wherein at least one of the light-sensitive layers, i.e., the red-sensitive layer unit, green-sensitive layer unit and blue-sensitive layer unit preferably contains a light-sensitive silver halide emulsion, in which at least 50% of the total grain projected area is accounted for by tabular silver halide grains having an aspect ratio of 12 or more. Tabular silver halide grains (hereinafter, also denoted simply as tabular grains) are crystallographically classified as twin crystal. The twin crystal refers to the crystal containing at least one twin plane within the crystal. Morphology of twin crystals in silver halide grains are detailed in Klein & Moisar, Photographishe Korrespondenz, vol.99, page 99 and vol. 100, page 57.

Tabular silver halide grains relating to the invention preferably have at least two parallel twin planes within the grain. The twin plane(s) exist substantially parallel to the face having the largest area among faces forming the grain surface (which is also called a major face). In the invention, the tabular grains preferably have two parallel twin planes. In the silver halide emulsion relating to the invention, at least 50% of the total projected area of tabular grains is preferably accounted for by tabular grains containing iodide and having an aspect ratio of 12 to 200, and more preferably 15 to 100. Adjustment of the aspect ratio of the tabular grains to the foregoing region can be achieved by selecting an appropriate preparation method from commonly known methods.

The aspect ratio of silver halide grains can be determined in such a manner that grain diameter and grain thickness are measured for respective grains by the method described below and the aspect ratio can be determined according to the following equation:

Aspect ratio=grain diameter/grain thickness.

The tabular grains relating to the invention preferably are those having (111) major faces and two twin planes parallel to the major faces. The average grain diameter is preferably 0.2 to 20 $\mu$m, more preferably 0.3 to 15 $\mu$m, and still more preferably 0.4 to 12 $\mu$m. The average grain diameter is an arithmetic average of grain diameters ($r_i$), provided that the significant digits are three, the least digit number is rounded and the number of measured grains is randomly selected 1000 or more. The grain diameter ($r_i$) is referred to as a diameter of a circle having the same area as the projection when viewed vertically to the major faces of the tabular grain. The grain diameter ($r_i$) can be determined in such a manner that silver halide grains are photographed under magnification by a factor of 10,000 to 70,000 using an electron-micrograph, and from the obtained electron-micrograph, the grain diameter or projection area is measured.

To determine the grain diameter and aspect ratio, the grain projection area and grain thickness for each grain can be determined in the following manner. Together with latex balls having a known grain diameter as an internal standard, silver halide grains are coated on a support so that the major faces are arranged parallel to the substrate. After performing shadowing to the grains on the thus coated sample by the carbon evaporation at a given angle, a replica sample is prepared by the conventional replica method. Electron-micrographs of the sample are taken and the projection area and thickness for respective grains are determined using an image processing apparatus. In this case, the grain projection area can be determined from the projection area of the internal standard and the grain thickness can also calculated from the internal standard and the grain shadow length.

In addition to the foregoing tabular grains, any grains may be used in combination, such as a polydisperse emulsion having a broad grain size distribution or a monodisperse emulsion having a narrow grain size distribution. When the grain size distribution is defined as below, the distribution is preferably less than 30%, and more preferably less than 25%:

Grain size distribution (%)=(standard deviation of grain size/average grain size)×100

The tabular silver halide grains used in the invention preferably contain iodide. The average iodide content of the tabular grains is preferably 0.5 to 40 mol %, more preferably 0.5 to 30 mol %, and still more preferably 1.0 to 25 mol %. The iodide content of silver halide grains can be determined by the EPMA method (or Electron Probe Micro Analysis). Thus, silver halide grains are dispersed so as to be not in contact with each other to prepare a sample. The sample is irradiated with an electron beam, while cooling at a temperature of not more than 100° C. using liquid nitrogen, and characteristic X-ray intensities of silver and iodine, radiated from a single silver halide grain are measured to determine iodide contents of the grain. According to the foregoing manner, iodide contents determined for respective grains are measured for at least 100 grains and an averaged value thereof are defined as an average iodide content of the grains.

The tabular silver halide grains relating to the invention preferably contain dislocation lines. The form of the dislocation lines can be optimally selected. There can be selected, for example, dislocation lines linearly existing in the specific direction to the crystal orientation, and curved dislocation lines. Furthermore, the dislocation lines may also selected from forms such as existence in the overall grain and existence in the specific site of the grain. For example, the dislocation lines exist only in the fringe (or circumferential) portion of the grain, the dislocation lines existing only on the major faces or being concentrated in the vicinity of corners of the grain. In the tabular silver halide grain emulsion relating to the invention, the dislocation lines preferably exist at least in the fringe portion, and more preferably in the fringe portion and on the major faces. The number of dislocation lines in the tabular grains relating to the invention is not specifically limited and it is preferred in the invention that at least 80% of the total projected area of the tabular grains is accounted for by tabular grains having at least 30 dislocation lines per grain in the fringe portion. Introduction of the dislocation lines into the tabular grains is accomplished preferably by using fine silver iodide grains or halide ion-releasing compounds.

Reduction sensitization, oxidizing agents for silver, fine silver halide grains or ultrafiltration may be employed in the process of preparing tabular silver halide grains relating to the invention. Preparation conditions for the tabular silver halide grains may be referred to Japanese Patent Application No. 2000-055636. In the preparation of silver halide emulsions relating to the invention, conditions other than the foregoing can be optimally selected with reference to the description in JP-A Nos. 61-6643, 61-14630, 61-112142, 62-157024, 62-18556, 63-92942, 63-151618, 63-163451, 63-220238 and 63-311244; Research Disclosure (hereinafter, also denoted as RD) 38957, items I and III, and RD40145, item XV.

The silver halide color photographic material preferably has a specified photographic speed of not less than 320, and more preferably not less than 640. The specified photographic speed refers to a speed determined in accordance with the definition described in JP-A No. 4-369644, which is defined in Japanese Industrial Standard JIS K7614-1981, corresponding to the ISO speed as international standard. The photographic sensitometry is as follows. After allowed to stand under an atmosphere at a temperature of 20±5° C. and a relative humidity of 60±10% for at least one hr., a photographic material is exposed to light. Exposure is conducted in accordance with the relative spectral energy and the intensity variation method described in JP-A No. 4-369644 and the exposure time is 1/100 sec. After completion of exposure, processing is also conducted in the same manner as described in JP-A No. 4-369644. In the densitometry, Status M density is measured and the specified photographic speed is determined in the same manner as described in JP-A 4-369644, in accordance with the following procedure:

1. Exposure (LogH) necessary to obtain a density higher by 0.15 than the minimum density for each of blue, green and red is represented in terms of lux·sec. and denoted as HB, HG and HR, respectively;
2. Of the foregoing HB and HR, the larger one (corresponding to a lower speed) is denoted as HS;
3. the specified photographic speed S is determined according to the following equation:

$$S=[2/(HG\times HS)]^{1/2}.$$

There will be further described constitution factors relating to the silver halide color photographic material, other than the items described above.

In addition to the foregoing tabular silver halide grains, silver halide grain emulsions which were prepared with reference to JP-A Nos. 61-6643, 61-14630, 61-112142, 62-157024, 62-18556, 63-92942, 63-151618, 63-163451, 63-220238, 63-311244; RD38957, items I and III and RD40145, item XV may also be employed as a silver halide emulsion usable in the color photographic material of the invention.

Silver halide emulsions used in the silver halide color photographic material of the invention, which have been subjected to physical ripening, chemical ripening and spectral sensitization are preferably employed. Additives used in such processes are described in RD38957, items IV and V, and RD40145, item XV. Commonly known photographic additives usable in the invention include, for example, those described in RD38957, items II through X and RD40145, items I through XIII.

Couplers can be incorporated to each of re-, green- and blue-sensitive silver halide emulsion layers of the color photographic material. Dyes that are formed of the couplers contained in the respective layers preferably exhibit spectral absorption maximums which are apart by at least 20 nm from each other. Cyan, magenta and yellow couplers are preferably used in the invention. Preferred combinations of the light-sensitive layer and coupler are combinations of a yellow coupler and a blue-sensitive layer, a magenta coupler and a green-sensitive layer, and a cyan coupler and a red-sensitive layer. However, the combination is not limited to these and other combinations may be applied.

There may be used a DIR compound in the invention. Examples of a DIR compound usable in the invention include compounds D-1 through D-34 described in JP-A 4-114153. Other examples of the DIR compound usable invention include those described in U.S. Pat. Nos. 4,234,678, 3,227,554 3,647,291, 3,958,993, 4,419,886 and 3,933,500; JP-A Nos. 57-56837 and 51-13239; U.S. Pat. Nos. 2,072,363 and 2,070,266; and RD40145, item XIV. Exemplary examples of couplers usable in the invention are described, for example, in RD40145, item II.

Additives used in the invention can be incorporated through dispersion described in RD40145, item VIII. There may also be used commonly known supports described in the foregoing RD38957, item XV. The photographic material of the invention may be provided with an auxiliary layer such as a filter layer or an interlayer, as described in RD38957, item XI.

Photographic materials can take any layer arrangement, such as normal layer arrangement, reverse layer arrangement and unit constitution. The silver halide emulsion relating to the invention can be applied to a variety of color photographic materials, such as color negative film for general or cine use, color reversal film for slide or television, color paper, color positive film, and color reversal paper.

The silver halide color photographic material relating to the invention can be processed using commonly known developers, for example, as described in T. H. James, The Theory of The Photographic Process, Forth Edition, pages 291–334; Journal of the American Chemical Society, 73 (3) 100 (1951). Processing can be conducted in accordance with commonly known methods, for example, as described in the foregoing RD38957, items XVII through XX and RD40145, item XXIII.

EXAMPLES

Embodiments of the silver halide color photographic material according to the invention will be described based on examples but are by no means limited to these. In examples, the term, part means part by weight.

Example 1

On a 120 μm thick, subbed triacetyl cellulose film support, the following layers having composition as shown below were formed to prepare a multi-layered color photographic material sample 101. The addition amount of each compound was represented in term of g/m$^2$, unless otherwise noted. The amount of silver halide or colloidal silver was converted to the silver amount and the amount of a sensitizing dye (denoted as "SD") was represented in mol/Ag mol.

| 1st Layer: Anti-Halation Layer | |
|---|---|
| Black colloidal silver | 0.16 |
| UV-1 | 0.30 |
| CM-1 | 0.12 |
| OIL-1 | 0.24 |
| Gelatin | 1.33 |
| **2nd Layer: Interlayer** | |
| Silver iodobromide emulsion i | 0.06 |
| AS-1 | 0.12 |
| OIL-1 | 0.15 |
| Gelatin | 0.67 |
| **3rd Layer: Low-speed Red-Sensitive Layer** | |
| Silver iodobromide emulsion h | 0.39 |
| Silver iodobromide emulsion e | 0.32 |
| SD-1 | $5.6 \times 10^{-4}$ |
| SD-2 | $3.72 \times 10^{-5}$ |
| SD-3 | $1.6 \times 10^{-4}$ |
| C-1 | 0.77 |
| CC-1 | 0.006 |
| OIL-2 | 0.47 |
| AS-2 | 0.002 |
| Gelatin | 1.79 |
| **4th Layer: Medium-speed Red-sensitive Layer** | |
| Silver iodobromide emulsion b | 0.83 |
| Silver iodobromide emulsion h | 0.36 |
| SD-11 | $1.60 \times 10^{-5}$ |
| SD-1 | $7.20 \times 10^{-4}$ |
| C-1 | 0.42 |
| CC-1 | 0.072 |
| DI-1 | 0.046 |
| OIL-2 | 0.27 |
| AS-2 | 0.003 |
| Gelatin | 1.45 |
| **5th Layer: High-speed Red-Sensitive Layer** | |
| Silver iodobromide emulsion a | 1.45 |
| Silver iodobromide emulsion e | 0.076 |
| SD-11 | $7.10 \times 10^{-6}$ |
| SD-1 | $3.20 \times 10^{-4}$ |
| C-2 | 0.10 |
| C-3 | 0.17 |
| CC-1 | 0.013 |
| DI-4 | 0.024 |
| DI-5 | 0.022 |
| OIL-2 | 0.17 |
| AS-2 | 0.004 |
| Gelatin | 1.40 |
| **6th Layer: Interlayer** | |
| Y-1 | 0.095 |
| AS-1 | 0.11 |
| OIL-1 | 0.17 |
| X-2 | 0.005 |
| Gelatin | 1.00 |
| **7th Layer: Low-speed Green-Sensitive Layer** | |
| Silver iodobromide emulsion h | 0.32 |
| Silver iodobromide emulsion e | 0.11 |
| SD-4 | $3.24 \times 10^{-5}$ |
| SD-5 | $5.21 \times 10^{-4}$ |
| SD-6 | $1.25 \times 10^{-4}$ |
| SD-7 | $1.59 \times 10^{-4}$ |
| M-1 | 0.375 |
| CM-1 | 0.042 |
| DI-2 | 0.010 |
| OIL-1 | 0.41 |
| AS-2 | 0.002 |
| AS-3 | 0.11 |
| Gelatin | 1.24 |
| **8th Layer: Medium-speed Green-Sensitive Layer** | |
| Silver iodobromide emulsion b | 0.66 |
| Silver iodobromide emulsion h | 0.11 |
| SD-4 | $2.14 \times 10^{-4}$ |
| SD-5 | $3.44 \times 10^{-4}$ |

-continued

| | |
|---|---|
| SD-6 | $1.73 \times 10^{-4}$ |
| SD-7 | $1.05 \times 10^{-4}$ |
| M-1 | 0.151 |
| CM-1 | 0.042 |
| CM-2 | 0.044 |
| DI-2 | 0.026 |
| DI-3 | 0.003 |
| OIL-1 | 0.27 |
| AS-3 | 0.046 |
| AS-4 | 0.006 |
| Gelatin | 1.22 |
| **9th Layer: High-speed Green-Sensitive Layer** | |
| Silver iodobromide emulsion a | 1.24 |
| Silver iodobromide emulsion e | 0.066 |
| SD-4 | $2.12 \times 10^{-5}$ |
| SD-5 | $3.42 \times 10^{-4}$ |
| SD-7 | $1.04 \times 10^{-4}$ |
| M-1 | 0.038 |
| M-2 | 0.078 |
| CM-2 | 0.010 |
| DI-3 | 0.003 |
| OIL-1 | 0.22 |
| AS-2 | 0.007 |
| AS-3 | 0.035 |
| Gelatin | 1.38 |
| **10th Layer: Yellow Filter Layer** | |
| Yellow colloidal silver | 0.053 |
| AS-1 | 0.15 |
| OIL-1 | 0.18 |
| Gelatin | 0.83 |
| **11th Layer: Low-speed Blue-sensitive Layer** | |
| Silver iodobromide emulsion g | 0.23 |
| Silver iodobromide emulsion d | 0.11 |
| Silver iodobromide emulsion c | 0.11 |
| SD-8 | $1.14 \times 10^{-4}$ |
| SD-9 | $1.62 \times 10^{-4}$ |
| SD-10 | $4.39 \times 10^{-4}$ |
| Y-1 | 0.90 |
| DI-3 | 0.002 |
| OIL-1 | 0.29 |
| AS-2 | 0.X-1 |
| 0.10 | |
| Gelatin | 1.79 |
| **12th Layer: High-sped Blue-sensitive Layer** | |
| Silver iodobromide emulsion f | 1.34 |
| Silver iodobromide emulsion g | 0.25 |
| SD-8 | $4.11 \times 10^{-5}$ |
| SD-9 | $1.95 \times 10^{-5}$ |
| SD-10 | $1.59 \times 10^{-4}$ |
| Y-1 | 0.33 |
| DI-5 | 0.12 |
| OIL-1 | 0.17 |
| AS-2 | 0.010 |
| X-1 | 0.098 |
| Gelatin | 1.15 |
| **13th Layer: First Protective Layer** | |
| Silver iodobromide emulsion i | 0.20 |
| UV-1 | 0.11 |
| UV-2 | 0.055 |
| X-1 | 0.078 |
| Gelatin | 0.70 |
| **14th Layer: Second protective Layer** | |
| PM-1 | 0.13 |
| PMMA | 0.018 |
| WAX-1 | 0.021 |
| SU-1 | 0.002 |
| SU-2 | 0.002 |
| Gelatin | 0.55 |

Characteristics of silver iodobromide emulsions used in sample 101, which were prepared in accordance with conventional method are shown below, wherein the average grain size refers to an edge length of a cube having the same volume as that of the grain.

| Emulsion | Av. Grain Size (μm) | Av. Iodide Content (mol %) | Diameter/thickness Ratio |
|---|---|---|---|
| a | 1.00 | 3.2 | 7.0 |
| b | 0.70 | 3.3 | 6.5 |
| c | 0.30 | 1.9 | 5.5 |
| d | 0.45 | 4.0 | 6.0 |
| e | 0.27 | 2.0 | Cubic |
| f | 1.20 | 8.0 | 5.0 |
| 9 | 0.75 | 8.0 | 4.0 |
| h | 0.45 | 4.0 | 6.0 |
| i | 0.03 | 2.0 | 1.0 |

Silver iodobromide emulsions e, g and h each contain iridium and ruthenium of $1\times10^{-7}$ to $1\times10^{-6}$ mol/molAg and $1\times10^{-7}$ to $1\times10^{-6}$ mol/molAg, respectively.

With regard to the foregoing emulsions, except for emulsion i, after adding the foregoing sensitizing dyes to each of the emulsions and ripening the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aid SU-3; a dispersing aid SU-4; viscosity-adjusting agent V-1; stabilizer ST-1; two kinds polyvinyl pyrrolidone of weight-averaged molecular weights of 10,000 and 1.100,000 (AF-1, AF-2); calcium chloride; inhibitors AF-3, AF-4, AF-5, Af-6 and AF-7; hardener H-1; and antiseptic Ase-1. As gelatin, there was used conventional lime-processed gelatin containing Ca ion of 1200 to 1500 ppm and exhibiting an isoelectric point of ca. 4.8. The hardener H-1 was added to coating solutions for the 13th and 14th layers immediately before coating using an in-line mixer, in amounts of 0.15 g/m$^2$ and 0.09 g/m$^2$, respectively.

Chemical structures for each of the compounds used in the foregoing sample are shown below.

Y-1

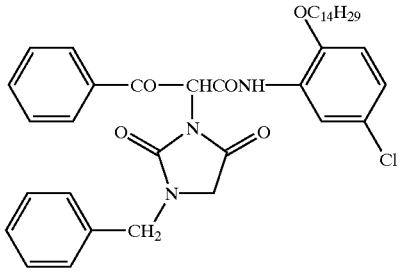

M-1

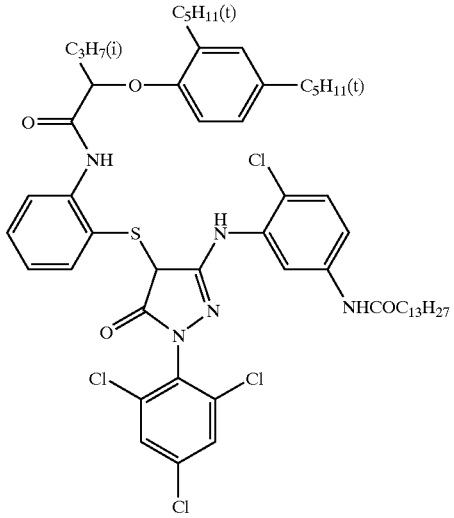

M-2

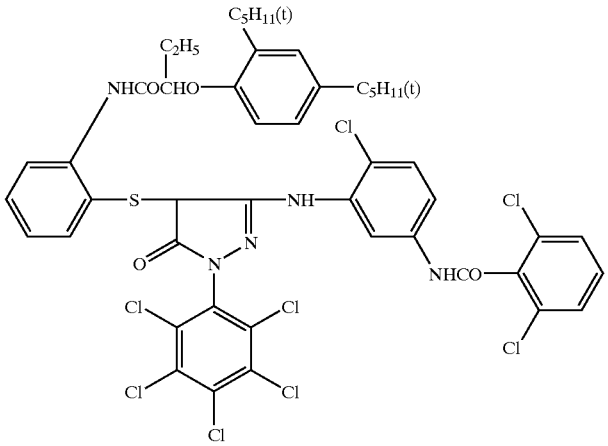

-continued
C-1
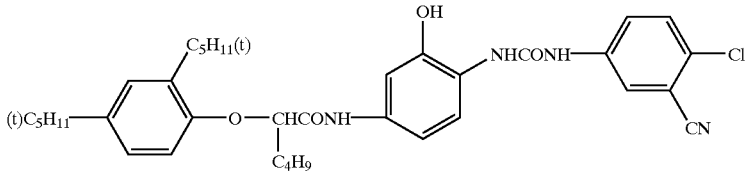
C-2
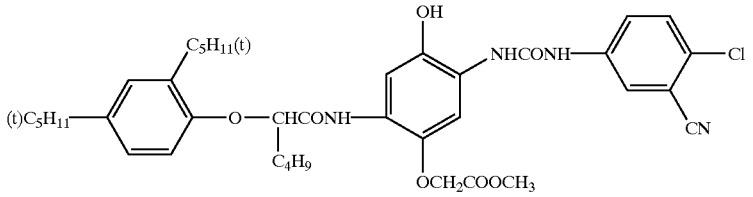
C-3
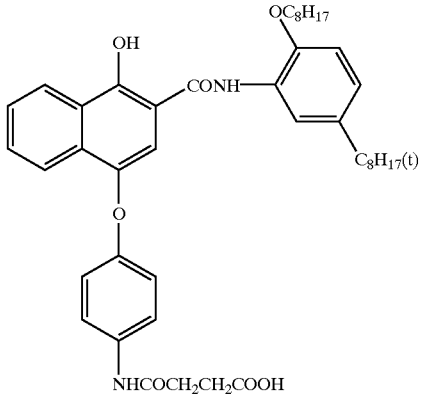
CC-1
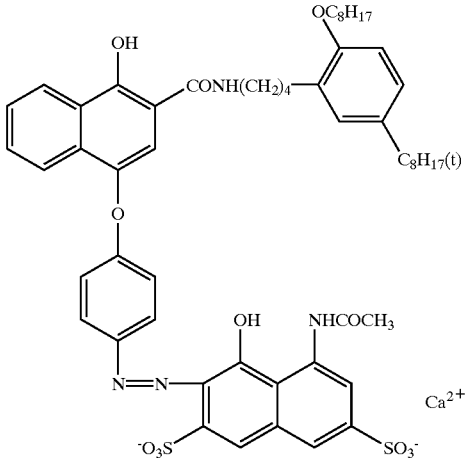
CM-1
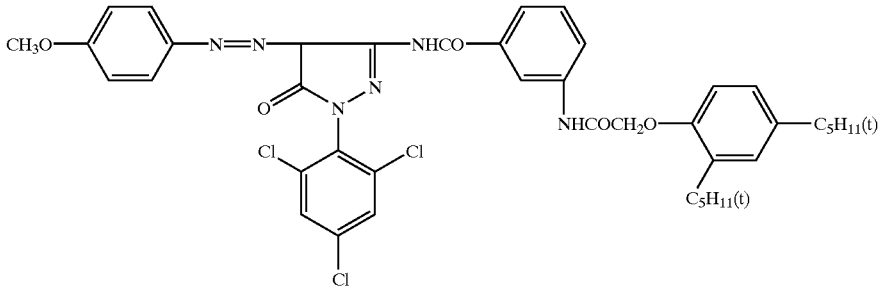
CM-2
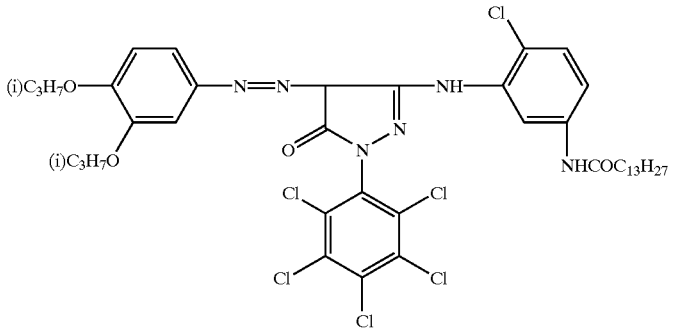

-continued
DI-1
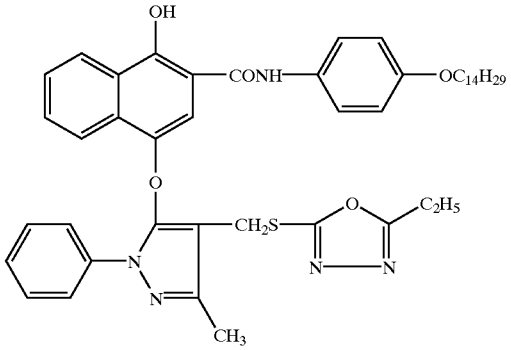
DI-2
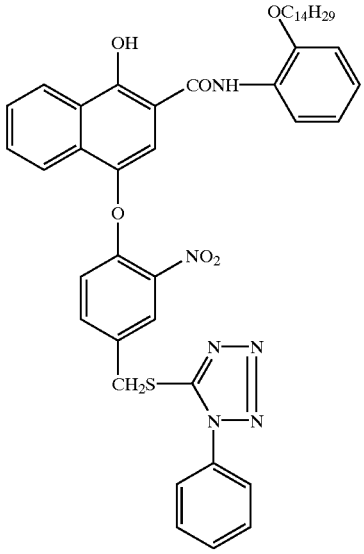
DI-3
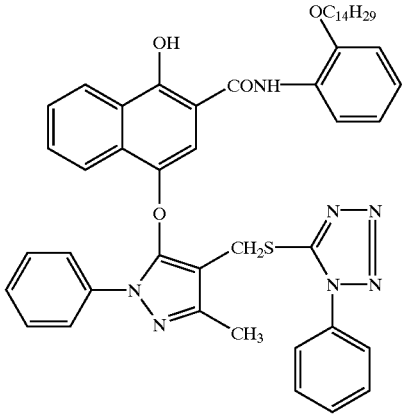
DI-4
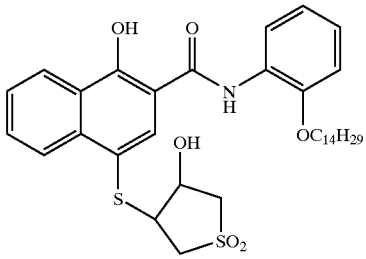
DI-5
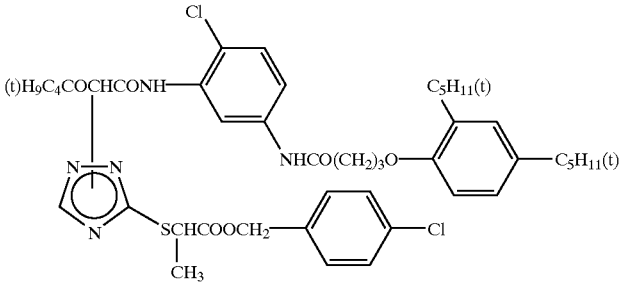
SD-1
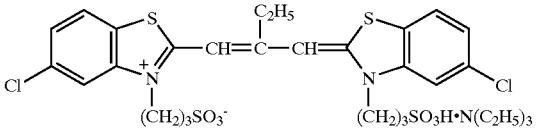
SD-2
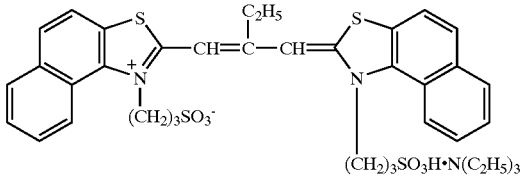
SD-3
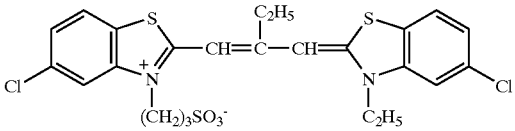
SD-4
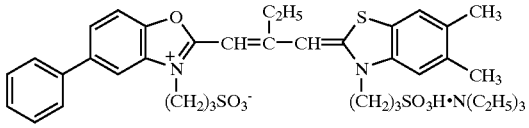

-continued
SD-5
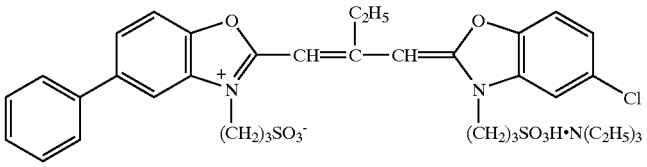
SD-6
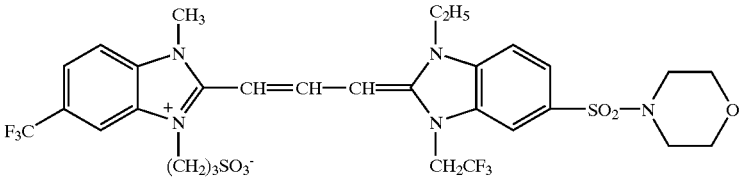
SD-7
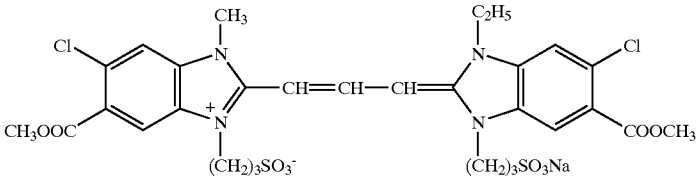
SD-8
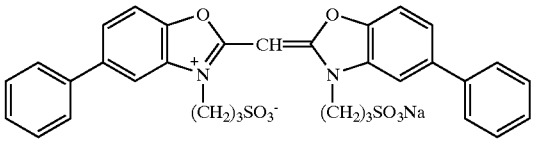
SD-9
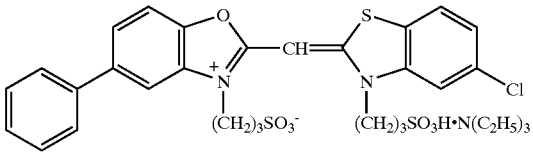
SD-10
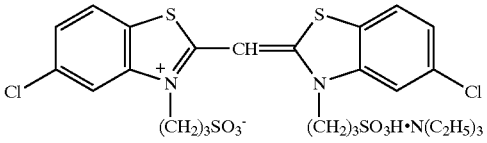
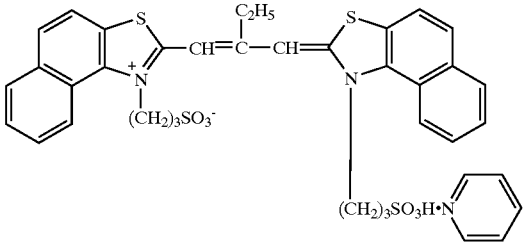
AS-1
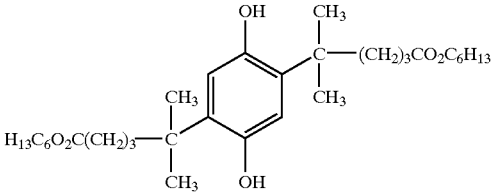
AS-2
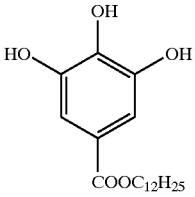
AS-3
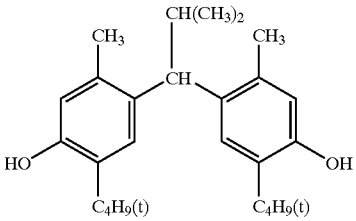
AS-4
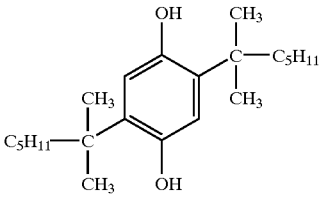
OIL-1
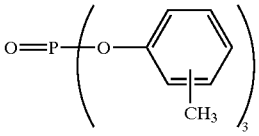
UV-1
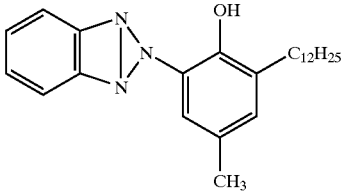

-continued
$H_9C_4OOC(CH_2)_8COOC_4H_9$
OIL-2
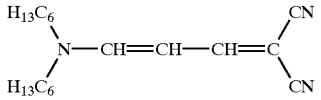
UV-2
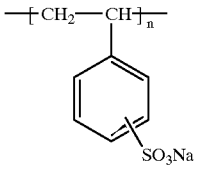
n: Degree of polymerization
V-1
Ase-1
(Mixture)
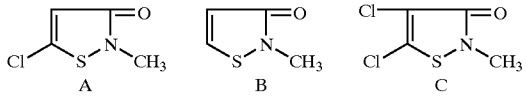
A:B:C = 50:46:2 (Molar ratio)
$CH_2{=}CHSO_2CH_2CONHCH_2CH_2NHCOCH_2SO_2CH{=}CH_2$
H-1
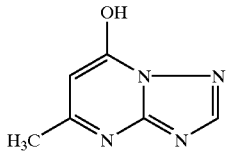
ST-1
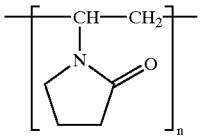
AF-1 Mw ≈ 10,000
AF-2 Mw ≈ 100,000
n: Degree of polymerization
AF-1,2
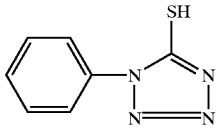
AF-3
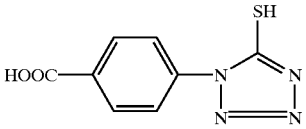
AF-4
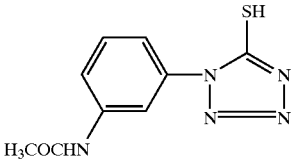
AF-5
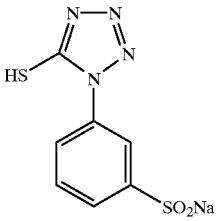
AF-6
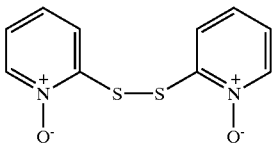
AF-7
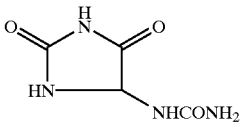
X-1
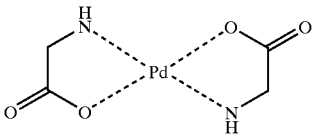
X-2
$C_8F_{17}SO_2N(C_3H_7)CH_2COOK$
SU-1
$C_8F_{17}SO_2NH(CH_2)_3\overset{+}{N}(CH_3)_3Br^-$
SU-2
$CH_2COOCH_2CH(C_2H_5)C_4H_9$
$CHCOOCH_2CH(C_2H_5)C_4H_9$
$SO_3Na$
SU-3
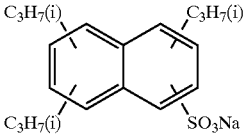
SU-4

-continued

WAX-1

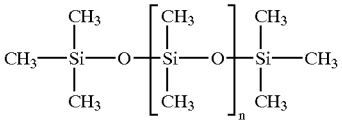

Mw = 3,000

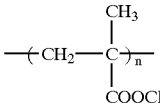

Av. particle size: 3.0 μm
Weight-average Mw: 20,000

PM-1

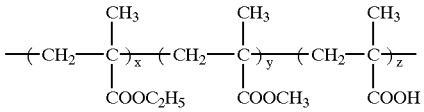

x:y:z = 3:3:4

PMMA

Sample 102 through 110 were prepared similarly to sample 101, except that oil-soluble organic basic compounds as shown in Table were added to the 7th, 8th and 9th layers, in amounts of 100, 50 and 30 mg/m$^2$, respectively, and cationic potato starch was further added to each of the 7th, 8th and 9th layers in an amount of 0.14 g/m$^2$ and to the 10th layer in an amount of 0.22 g/m$^2$.

TABLE 1

| Sample No. | Basic Compound (pKa) | Cation Starch |
|---|---|---|
| 101 | — | — |
| 102 | Compd.-1 (3.3) | — |
| 103 | Compd.-2 (5.0) | — |
| 104 | Compd.-3 (8.7) | — |
| 105 | OC-4 (6.2) | — |
| 106 | OC-6 (7.2) | — |
| 107 | Compd.-2 (5.0) | YES |
| 108 | Compd.-3 (8.7) | YES |
| 109 | OC-4 (6.2) | YES |
| 110 | OC-6 (7.2) | YES |

Comparative compound-1 (Compd.-1)

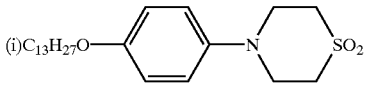

Comparative compound-2 (Compd.-2)

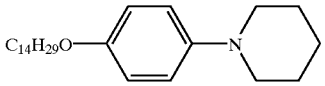

Comparative compound-3 (Compd.-3)

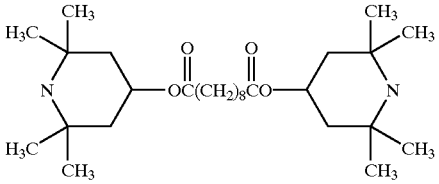

Samples were each subjected to an exhaust-gas resistance test in the following manner.

Exhaust Gas Resistance Test

In a 60 m$^3$ room ventilated at 5 m$^3$/min, an oil fan heater (HITACHI Fan Heater TITAN BURNER OVF-356), which was fueled with kerosene (product by NISSEKI-MITSUBISHI LTD) was set at 30° C. and was automatically and intermittently operated simultaneously with a humidifier, which was set to a relative humidity of 76%. Two sets of the samples, which were packaged in a gas permeable light-shielding bag were prepared and allowed to stand for a period of 1 week (1 W) or 3 weeks (3 W). The thus aged samples were subjected to sensitometry, together with samples that were not exposed to the gas exhausted from the oil fan heater.

Exposure and Processing

The thus obtained samples were exposed to white light at 1.6 CMS for 1/200 sec. through an optical stepped wedge and subjected to color processing in accordance with the processing steps described in JP-A No. 10-123652, col. 0220 through 0227.

Sensitometry

The thus processed samples were measured with respect to a magenta transmission density component by green light photometry using a densitometer produced by X-Rite Co. and characteristic curves comprised of the density D (ordinate) and the logarithmic exposure Log E (abscissa) were prepared to determine sensitivity, fog density, densities at specific points and maximum density. Results are shown in Table 2. In the Table, the Sensitivity Reduction (%) indicates a decrement (percentage) of relative sensitivity at a density of the minimum density plus 0.2 of the sample exposed to exhaust gas, compared to that of the sample unexposed to the exhaust gas. The fog increment is the difference of fog density of an exhaust-unexposed sample ($F_0$) from that of an exhaust-exposed sample (F), i.e., F minus $F_0$. The density difference is a density decrement of an exhaust-exposed sample at the exposure point corresponding to a density of 1.5 of the exhaust-unexposed sample.

TABLE 2

| Sample | Sensitivity Reduction (%) | | Fog Increment | | Density Difference | |
|---|---|---|---|---|---|---|
| No. | 1W | 3W | 1W | 3W | 1W | 3W |
| 101 | 7 | 19 | 0.02 | 0.05 | 0.09 | 0.22 |
| 102 | 6 | 17 | 0.02 | 0.04 | 0.09 | 0.20 |
| 103 | 6 | 16 | 0.02 | 0.04 | 0.08 | 0.20 |
| 104 | 6 | 14 | 0.02 | 0.04 | 0.08 | 0.21 |
| 105 | 4 | 10 | 0.02 | 0.02 | 0.07 | 0.17 |
| 106 | 5 | 11 | 0.02 | 0.03 | 0.07 | 0.17 |
| 107 | 6 | 15 | 0.02 | 0.04 | 0.08 | 0.20 |
| 108 | 5 | 13 | 0.02 | 0.03 | 0.07 | 0.19 |
| 109 | 2 | 5 | 0.01 | 0.02 | 0.05 | 0.09 |
| 110 | 2 | 5 | 0.01 | 0.02 | 0.05 | 0.10 |

As can be seen from Table 2, it was proved that the use of an oil-soluble organic basic compound having a specific pKa value in combination with a cationic starch led to superior resistance to exhaust gas.

Example 2

Photographic material samples 201 through 205 were prepared similarly to Example 1, provided that the high boiling solvent (OIL-1) of the 7th, 8th and 9th layers was replaced by a high boiling solvent (HBS3), as shown in Table 3.

TABLE 3

| Sample No. | Basic Compound (pKa) | Cationic Starch | High Boiling Solvent |
|---|---|---|---|
| 103 | Compd.-2 (5.0) | — | OIL-1 |
| 201 | Compd.-2 (5.0) | — | HBS3 |
| 202 | OC-4 (6.2) | — | HBS3 |
| 203 | OC-6 (7.2) | — | HBS3 |
| 204 | OC-4 (6.2) | YES | HBS3 |
| 205 | OC-6 (7.2) | YES | HBS3 |

The thus prepared samples were evaluated similarly to Example 1. Results thereof are shown in Table 4.

TABLE 4

| Sample | Sensitivity Reduction (%) | | Fog Increment | | Density Difference | |
|---|---|---|---|---|---|---|
| No. | 1W | 3W | 1W | 3W | 1W | 3W |
| 103 | 6 | 16 | 0.02 | 0.04 | 0.08 | 0.20 |
| 201 | 6 | 14 | 0.02 | 0.04 | 0.08 | 0.19 |
| 202 | 3 | 7 | 0.01 | 0.02 | 0.06 | 0.12 |
| 203 | 3 | 8 | 0.02 | 0.03 | 0.06 | 0.14 |
| 204 | 2 | 6 | 0.01 | 0.02 | 0.04 | 0.09 |
| 205 | 2 | 7 | 0.01 | 0.02 | 0.04 | 0.11 |

As apparent from Table 4, it was proved that the use of the oil-soluble organic basic compound having a specific pKa value in combination with a specific high boiling solvent led to superior resistance to exhaust gas.

Example 3

Photographic material samples 301 through 305 were prepared similarly to Example 1, provided that oil-soluble basic compounds were added to the 7th, 8th and 9th layers, and the compound forming a bivalent cation upon autooxidation (T-18) was added to the 7th, 8th and 9th layers, as shown in Table 5.

TABLE 5

| Sample No. | Basic Compound (pKa) | Cationic Starch | Compound (T-18) |
|---|---|---|---|
| 103 | Compd.-2 (5.0) | — | — |
| 301 | Compd.-2 (5.0) | — | YES |
| 302 | OC-4 (6.2) | — | YES |
| 303 | OC-6 (7.2) | — | YES |
| 304 | OC-4 (6.2) | YES | YES |
| 305 | OC-6 (7.2) | YES | YES |

The thus prepared samples were evaluated similarly to Example 1. The samples were further evaluated with respect to resistance to nitrogen dioxide gas in the following manner.

Nitrogen Dioxide Gas Resistance

A 22 liter glass vessel was charged with gas from a nitrogen dioxide gas-filled cylinder so as to contain gas having a nitrogen dioxide concentration of 5 ppm at a relative humidity of 76% at 23° C. Samples were allowed to age in the vessel for 4 weeks. The thus aged samples were subjected to sensitometry and compared to samples unexposed to nitrogen dioxide gas. Exposure, processing and sensitometry were conducted similarly to Example 1. Results are shown in Table 6. In the Table, the gradient variation indicates a decrement of the average gradient of the nitrogen dioxide gas-exposed sample, based on that of the nitrogen dioxide gas-unexposed sample, wherein the average gradient is an average gradient value between densities of 0.7 and 1.7 on the characteristic curve.

TABLE 6

| Sample No. | Sensitivity Reduction (%) | Density Difference | Gradient Variation | Fog Increment |
|---|---|---|---|---|
| 103 | 12 | 0.10 | 0.021 | 0.01 |
| 301 | 10 | 0.08 | 0.017 | 0.01 |
| 302 | 3 | 0.02 | 0.003 | 0.01 |
| 303 | 4 | 0.02 | 0.003 | 0.01 |
| 304 | 2 | 0.01 | 0.003 | 0.01 |
| 305 | 2 | 0.01 | 0.003 | 0.01 |

As apparent from Table 6, it was proved that the use of the oil-soluble organic basic compound having a specific pKa value in combination with the compound forming a bivalent cation upon autooxidation led to superior resistance to nitrogen dioxide gas.

Example 4

Photographic material samples 401 through 405 were prepared similarly to Example 1, provided that oil-soluble basic compounds were added to the 7th, 8th and 9th layers, in combination with the radical scavenger (2-2) of 4.0 $mg/m^2$, as shown in Table 7.

TABLE 7

| Sample No. | Basic Compound (pKa) | Cationic Starch | Radical Scavenger |
|---|---|---|---|
| 103 | Compd.-2 (5.0) | — | — |
| 401 | Compd.-2 (5.0) | — | YES |
| 402 | OC-4 (6.2) | — | YES |
| 403 | OC-6 (7.2) | — | YES |
| 404 | OC-4 (6.2) | YES | YES |
| 405 | OC-6 (7.2) | YES | YES |

The thus prepared samples were evaluated with respect to resistance to nitrogen dioxide gas, similarly to Example 3. Results are shown in Table 8.

TABLE 8

| Sample No. | Sensitivity Reduction (%) | Density Difference | Gradient Variation | Fog Increment |
|---|---|---|---|---|
| 103 | 12 | 0.10 | 0.021 | 0.01 |
| 401 | 10 | 0.07 | 0.015 | 0.01 |
| 402 | 4 | 0.02 | 0.003 | 0.01 |
| 403 | 5 | 0.02 | 0.003 | 0.01 |
| 404 | 3 | 0.01 | 0.002 | 0.01 |
| 405 | 3 | 0.01 | 0.003 | 0.01 |

As apparent from Table 8, it was proved that the use of the oil-soluble organic basic compound having a specific pKa value in combination with the radical scavenger led to superior resistance to nitrogen dioxide gas.

Example 5

Photographic material samples 501 through 509 were prepared similarly to Example 1, provided that oil-soluble basic compounds were added to the 7th, 8th and 9th layers, and coating solutions of respective component layers were adjusted to a pH value and a silver potential value so as to have a layer surface pH and a film silver potential (denoted as EAg), as shown in Table 9.

TABLE 9

| Sample No. | Basic Compound (pKa) | Cationic Starch | Surface pH | EAg |
|---|---|---|---|---|
| 103 | Compd.-2 (5.0) | — | 5.9 | 140 |
| 501 | Compd.-2 (5.0) | — | 5.9 | 120 |
| 502 | OC-4 (6.2) | — | 5.9 | 120 |
| 503 | OC-6 (7.2) | — | 5.9 | 120 |
| 504 | OC-4 (6.2) | — | 5.9 | 105 |
| 505 | OC-6 (7.2) | — | 5.9 | 105 |
| 506 | OC-4 (6.2) | YES | 5.9 | 120 |
| 507 | OC-6 (7.2) | YES | 5.9 | 120 |
| 508 | OC-4 (6.2) | YES | 5.9 | 105 |
| 509 | OC-6 (7.2) | YES | 5.9 | 105 |

The thus prepared samples were evaluated with respect to resistance to nitrogen dioxide gas, similarly to Example 3. Results are shown in Table 10.

TABLE 10

| Sample No. | Sensitivity Reduction (%) | Density Difference | Gradient Variation | Fog Increment |
|---|---|---|---|---|
| 103 | 12 | 0.10 | 0.021 | 0.01 |
| 501 | 10 | 0.08 | 0.019 | 0.01 |
| 502 | 7 | 0.05 | 0.009 | 0.01 |
| 503 | 8 | 0.05 | 0.008 | 0.01 |
| 504 | 6 | 0.04 | 0.006 | 0.01 |
| 505 | 6 | 0.04 | 0.007 | 0.01 |
| 506 | 5 | 0.03 | 0.006 | 0.01 |
| 507 | 6 | 0.03 | 0.006 | 0.01 |
| 508 | 4 | 0.02 | 0.004 | 0.01 |
| 509 | 5 | 0.02 | 0.005 | 0.01 |

As apparent from Table 10, it was proved that the use of the oil-soluble basic compound having a specific pKa value in combination with adjustment of the layer surface pH and film silver potential to specific values led to superior resistance to nitrogen dioxide gas.

Example 6

Photographic material samples 601 through 602 were prepared similarly to samples 105 and 109 of Example 1, respectivly, provided that the silver iodobromide emulsion a used in the 5th and 9th layers was replaced by an equimolar amount of a hexagonal tabular grain emulsion Em-1 having an average iodide content of 3.2 mol %, average grain diameter of 1.4 $\mu$m and a grain size distribution of 17%, in which 50% of the total grain projected was accounted for by tabular grain having an aspect ratio of 15 or more and 80% of the total grain projected area was accounted for by silver halide grains having at least 30 dislocation lines in the fringe portions, as shown in Table 11.

TABLE 11

| Sample No. | Basic Compound (pKa) | Cationic Starch | Em-1 |
|---|---|---|---|
| 105 | OC-4 (6.2) | — | — |
| 109 | OC-4 (6.2) | YES | — |
| 601 | OC-4 (6.2) | — | YES |
| 602 | OC-4 (6.2) | YES | YES |

Samples were evaluated similarly to Example 1 and results are shown in Table 12.

TABLE 12

| Sample | Sensitivity Reduction (%) | | Fog Increment | | Density Difference | |
|---|---|---|---|---|---|---|
| No. | 1W | 3W | 1W | 3W | 1W | 3W |
| 105 | 4 | 10 | 0.02 | 0.02 | 0.07 | 0.17 |
| 109 | 2 | 5 | 0.01 | 0.02 | 0.05 | 0.09 |
| 601 | 3 | 8 | 0.01 | 0.02 | 0.05 | 0.10 |
| 602 | 2 | 5 | 0.01 | 0.02 | 0.04 | 0.07 |

As apparent from Table 12, it was proved that the use of the oil-soluble basic compound having a specific pKa value in combination with a high aspect ratio tabular grain emulsion led to superior resistance to exhaust gas.

Example 7

Photographic material sample 701 was prepared similarly to sample 602 of Example 6, provided that (i) the high boiling solvent used in the 7th, 8th and 9th layers was replaced by an equivalent weight of the high boiling solvent (HBS 3), (ii) the compound forming a bivalent cation upon autooxidation (T-18) of $1\times10^{-5}$ mol per mol silver halide was added to each of the 7th, 8th and 9th layers, (iii) the radical scavenger (2-2) of 4.0 mg/m$^2$ to each of the 7th, 8th and 9th layers, (iv) the layer surface pH and film silver potential were adjusted to 5.9 and 105 mV, respectively.

The sample 701 was evaluated similarly to Example 1 and results are shown in Table 13.

TABLE 13

| Sample No. | Sensitivity Reduction (%) | Density Difference | Gradient Variation | Fog Increment |
|---|---|---|---|---|
| 701 | 2 | 0.01 | 0.02 | 0.01 |

As can be seen from Table 13, it was proved that superior exhaust resistance was achieved according to the invention.

What is claimed is:

1. A silver halide color photographic material comprising a support having on one side thereof component layers comprising a red-sensitive layer, a green-sensitive layer, a blue-sensitive layer and a light-insensitive layer, wherein at least one of the component layers contains an oil-soluble organic basic compound exhibiting a pKa value of 5.5 to 8.5, and at least one of the component layers contains a cationic starch.

2. The photographic material of claim 1, wherein the oil-soluble organic basic compound is represented by the following formula (V):

formula (V)

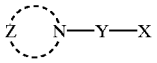

wherein X represents an electron-attractive group having a Hammett's substituent constant σp value of 0.25 or more; Y represents an alkylene group in which the carbon number of the main chain is 1 through 3; Z represents a non-metallic atom group necessary to form a 5- to 7-membered non-aromatic heterocycle together with a nitrogen atom, and wherein when Z contains a second nitrogen atom and there is no nitrogen atom in Z more than two, the compound includes a substituent (—Y'—X') which is attached to the second nitrogen, in which X' is the same as defined in X and Y' is the same as defined in Y, provided that there is no basic amino group other than a basic skeleton of a non-aromatic heterocycle represented by the following formula:

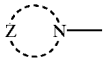

and the sum of the carbon number of the molecule is 14 or more.

3. The photographic material of claim 1, wherein at least one of the component layers contains a compound represented by the following formula (1):

$$RaOCO(CH_2)_mCOORb \qquad \text{formula (1)}$$

wherein Ra and Rb are independently a straight chain or branched alkyl group having 4 to 10 carbon atoms; and m is an integer of 2 to 10.

4. The photographic material of claim 1, wherein at least one of the component layers contains a compound capable of forming a bivalent cation upon autooxidation.

5. The photographic material of claim 4, wherein the compound capable of forming a bivalent cation upon autooxidation is represented by the following formula (4):

$$(E)_k\text{–}L_0\text{–}(Z_0)_1 \qquad \text{formula (4)}$$

wherein E represents a group promoting adsorption onto silver halide, $L_0$ represents a bond or a linkage group, $Z_0$ represents a group forming a two-electron oxidation product, k is 0 or an integer of 1 to 3 and 1 is 1 or 2.

6. The photographic material of claim 1, wherein at least one of the component layers contains a radical scavenger.

7. The photographic material of claim 1, wherein the photographic-material exhibits a layer surface pH of 5.6 to 6.2 and a film silver potential of 80 to 130 mV.

8. The photographic material of claim 1, wherein the oil-soluble organic basic compound exhibits a logP value of 8 to 14.

9. The photographic material of claim 1, wherein at least one of the red-sensitive layer, the green-sensitive layer and the blue-sensitive layer contains the oil-soluble organic basic compound.

10. The photographic material of claim 1, wherein at least one of the red-sensitive layer, the green-sensitive layer and the blue-sensitive layer comprises a silver halide emulsion comprising silver halide grains including tabular grains, (a) said tabular grains having an aspect ration of not less than 12 and accounting for at least 50% of total grain projected area, and (b) at least 80% of total projected area of said tabular grains being accounted for by grains having at least 30 dislocation lines per grain in the fringe portion of the grains.

* * * * *